US005390456A

United States Patent [19]

Platt et al.

[11] Patent Number: 5,390,456

[45] Date of Patent: * Feb. 21, 1995

[54] DECORATIVE SUSPENDED CEILING

[75] Inventors: William J. Platt, Aston, Pa.; Thomas E. Rose, Dunwoody, Ga.

[73] Assignee: National Rolling Mills, Inc., Frazer, Pa.

[ * ] Notice: The portion of the term of this patent subsequent to Sep. 7, 2010 has been disclaimed.

[21] Appl. No.: 89,452

[22] Filed: Jul. 7, 1993

Related U.S. Application Data

[60] Continuation-in-part of Ser. No. 797,629, Nov. 25, 1991, Pat. No. 5,241,798, which is a division of Ser. No. 38,442, Apr. 29, 1993, Pat. No. 5,279,033.

[51] Int. Cl.[6] ..... B44F 7/00; E04C 2/30; E04F 19/06; E04B 9/00

[52] U.S. Cl. ..... 52/311.2; 52/312; 52/664; 52/667; 52/727; 52/506.07

[58] Field of Search ..... 52/311.2, 311.3, 312, 52/DIG. 8, 506.6, 506.7, 664, 667, 727, 762, 461

[56] References Cited

U.S. PATENT DOCUMENTS

| | | |
|---|---|---|
| D. 268,786 | 4/1983 | Galindo . |
| 1,895,190 | 1/1933 | Jansen . |
| 2,752,017 | 6/1956 | Segil . |
| 3,319,389 | 5/1967 | Levine . |
| 3,355,206 | 11/1967 | Valsvik . |
| 3,570,198 | 3/1971 | Ruhnke . |
| 3,848,385 | 11/1974 | Thompson . |
| 4,034,531 | 7/1977 | Balinski . |
| 4,047,348 | 9/1977 | McSweeney . |
| 4,222,210 | 9/1980 | Hanstein et al. . |
| 4,422,272 | 12/1983 | Sutter . |
| 4,505,083 | 3/1985 | Mieyal . |
| 4,542,615 | 9/1985 | McCall . |
| 4,852,325 | 8/1989 | Dunn et al. . |
| 5,265,393 | 11/1993 | Bishel et al. ..... 52/461 |

OTHER PUBLICATIONS

International Search Report, PCT Appln. PCT/US92/10107, Search completed 07 Jan. 1993.

*Primary Examiner*—Carl D. Friedman
*Assistant Examiner*—Robert J. Canfield
*Attorney, Agent, or Firm*—Eugene Chovanes

[57] ABSTRACT

A grid beam of inverted T cross section for a suspended ceiling is made from a first strip of metal. A second strip is secured to the bottom of the flange of the beam between flats on the first strip, so that a three-dimensional effect from essentially flat elements results. The second strip can be of a different color as well as a different material or texture than the first strip, so that additionally a color contrast, as well as a material or surface contrast, can be achieved.

5 Claims, 4 Drawing Sheets

FIG. 7
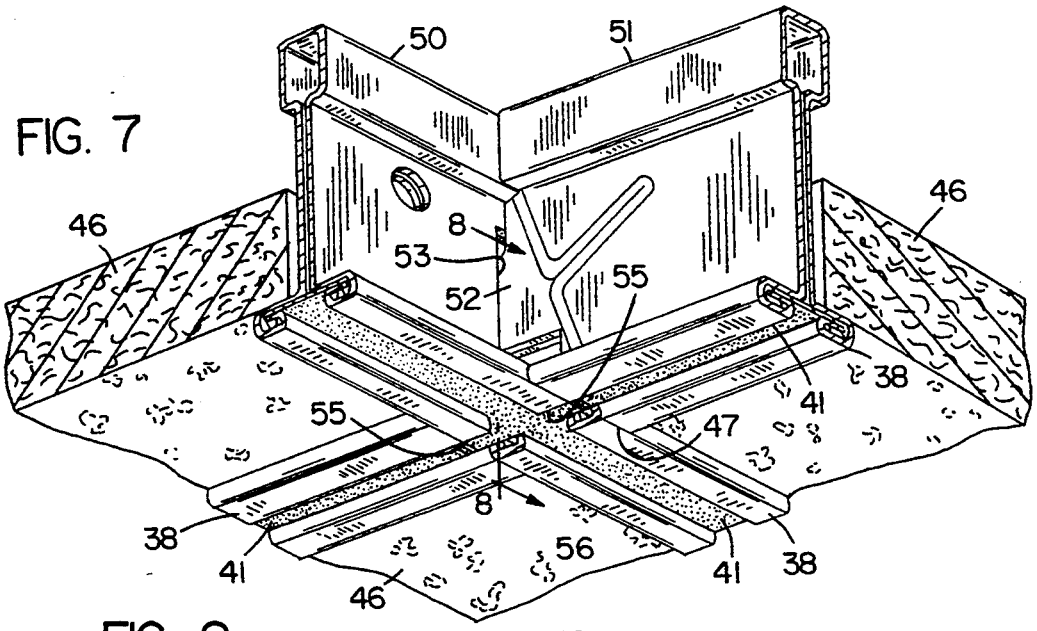
FIG. 8
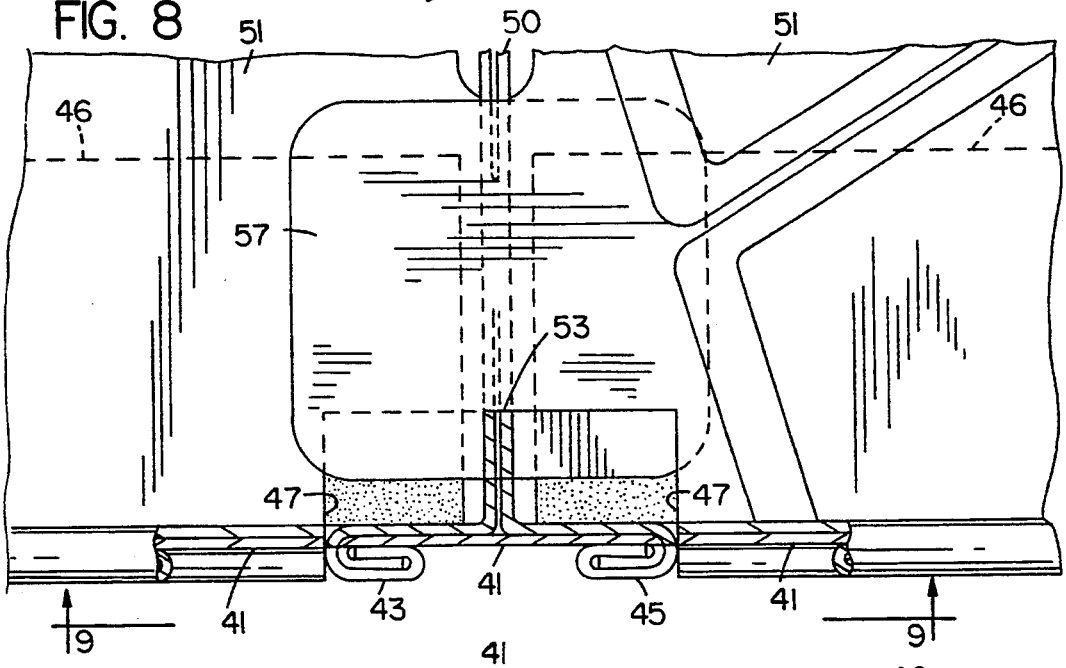
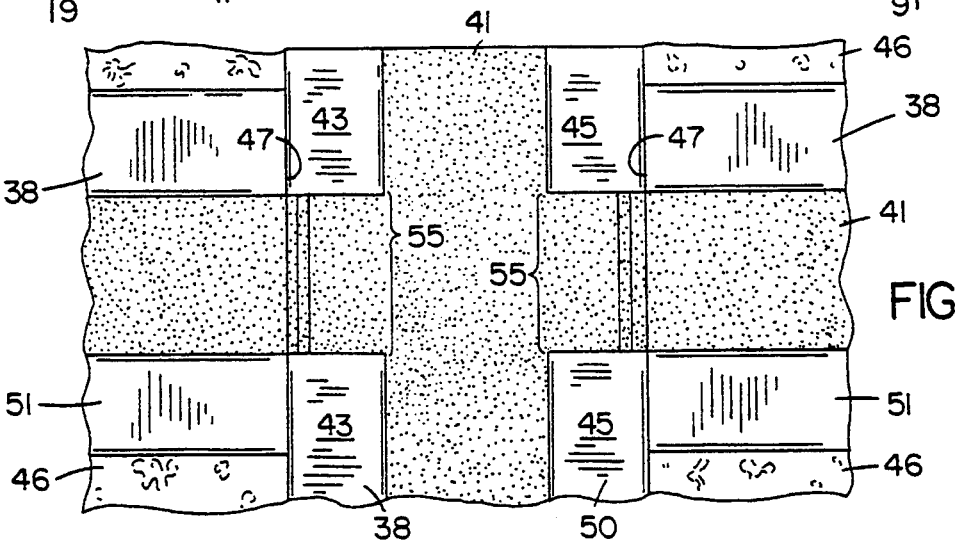
FIG. 9

DECORATIVE SUSPENDED CEILING

This application is a continuation-in-part of application Ser. No. 07/797,629, filed Nov. 25, 1991, now U.S. Pat. No. 5,241,798 for DECORATIVE SUSPENDED CEILING, and a divisional application, Ser. No. 08/038,442, filed Mar. 29, 1993, now U.S. Pat. No. 5,279,033 for METHOD OF MAKING DECORATIVE SUSPENDED CEILING.

BACKGROUND

1. Field of the Invention

Ceilings of the suspended type use beams extending in grid form to support tile.

The beams are of an inverted T cross section having either a flat or a channel bottom flange.

This invention relates to the bottom flange.

2. Prior Art

Sometimes it is desirable to use the beams and tiles in a suspended ceiling to achieve a decorative effect. An example is the achievement of a three-dimensional effect, as for instance by use of a channel flange and a beveled tile. Such a prior art construction is shown, for instance, in U.S. Pat. No. 4,422,272 (the '272 patent). The inside of the channel may be of a different color from the outside. A beveled edge tile is often used with such an arrangement where the tile may be of the color that is inside the channel, or still a third color on the tile may be used.

Such prior art ceiling yields a three-dimensional effect and, when different colors are used, an additional color effect.

Such a ceiling, although pleasing to view, is more expensive than a "flat" ceiling wherein a flat tile rests on a flat flange, because of the channel design.

Where continuity of the flange is desired at the beam intersections, one solution has been to place a notch on the support member at the intersection, but this substantially weakness the U-channel flange. Another solution is to use a clip of the groove color disclosed in the '272 patent. Such clip adds to the cost and complexity of the ceiling.

SUMMARY OF THE PRESENT INVENTION GENERALLY

The present invention achieves a three-dimensional effect and, optionally, a color, material, or texture effect, in what is a flat ceiling. By a flat ceiling is meant one in which the flanges of the T cross section grid beams are relatively thin and flat, as commonly produced for suspended ceilings, and the tile supported by the flanges is flat. Such a ceiling is the most economical to produce and install.

The three-dimensional effect is achieved by producing a flange which is formed by wrapping outer bends from a first strip from which the beam is being formed around a flat second strip, so that the effect from below is that of two surface levels in the flange, projecting to one standing on the floor and gazing at the ceiling, a pronounced three-dimensional effect. The second strip may be of a different material, texture, or color from the first material, to provide a decorative color effect and, in some instances, an even more pronounced three-dimensional effect.

Optionally, the bends of the flange may be cut out or notched at the intersections, exposing the inner second strip at these intersections in either direction. There is but a small amount of loss of beam strength from the notch at these intersections since the upper layer of the flange formed by the bends as well as the inner second strip remain intact at the cutouts. In effect what is a three-ply flange with the lower bends forming one of the plys is reduced in the vicinity of the intersection to two-ply only, which is more than adequate to maintain the integrity of the flange.

In effect, the present invention uses a flat flange T beam to achieve the three-dimensional effect of a channel T flange beam, without the increased cost and complexity of such prior art ceiling. Other effects can be obtained, when desired, by making the second strip of a different color, material, or texture from the first strip.

SUMMARY OF THE PRESENT INVENTION SPECIFICALLY

The second strip extends between the bends of the first strip but the bends of the first strip and the second are not inter-bent or overlapped. The second strip extends only between the bends of the first strip and is secured by a friction fit or adhesively to the bottom surface of the flange, or by welding as for instance spot welding, mechanically as for instance by periodically rivetting, or by any other suitable attaching means.

BRIEF DESCRIPTION OF THE DRAWINGS

FIG. 7 is a fragmentary perspective view showing a portion of metallic beam member having a lower terminal flange of the inverted T configuration and the second strip of this invention being intersected and interlocked by the terminal ends of two additional metallic beam members of like design. The beam members are shown supporting fragmentary end portions of three tiles or panels and the inner strips are continuous through the point of intersection.

FIG. 8 is an enlarged fragmentary sectional elevational view taken on the line 8,8 of FIG. 7, showing details of the interlocking beam members at a point of intersection, the abutment of the flanges of the left and right beam members to the centrally located beam flange and details of the cutout provided in the flange of the centrally located beam providing an aligned pathway for the strip.

FIG. 9 is a plan view taken on the line 9,9 of FIG. 8, illustrating the uninterrupted intersection of strip provided by the cutout.

BRIEF DESCRIPTION OF THE PREFERRED EMBODIMENT

Prior Art

Figure 1:
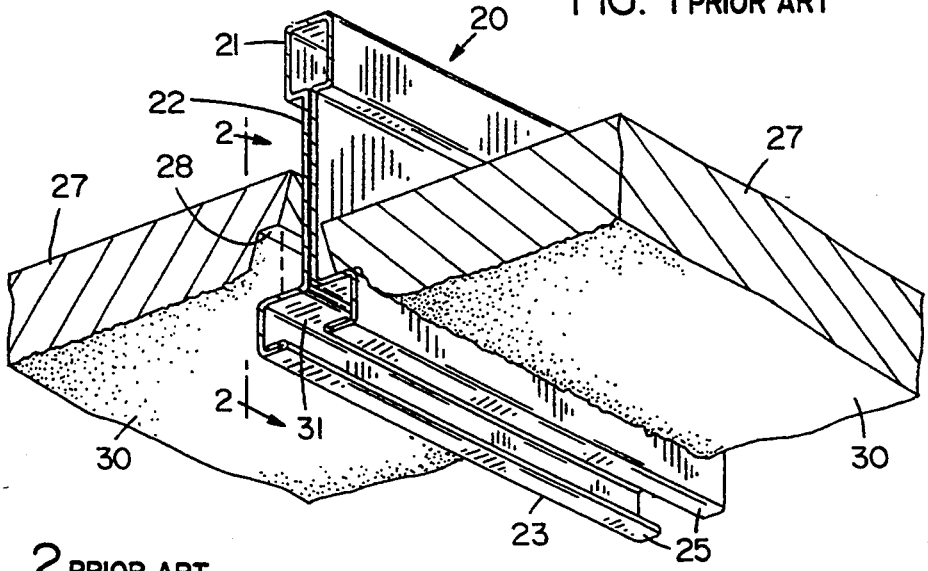
FIG. 1 PRIOR ART
FIG. 1 is a fragmentary perspective view illustrating a portion of a typical metallic beam member having a channel flange for the support of ceiling tiles or panels. Two fragmentary tiles are shown in the drawing; the left-hand panel being slightly elevated above the channel supporting flange to show the stepped configuration of the tile edge. The metallic beam member is often of a single color of white, but sometimes has a different color in the inner groove. This type of ceiling grid and panel construction is well known and is designated prior art.
Figure 2:
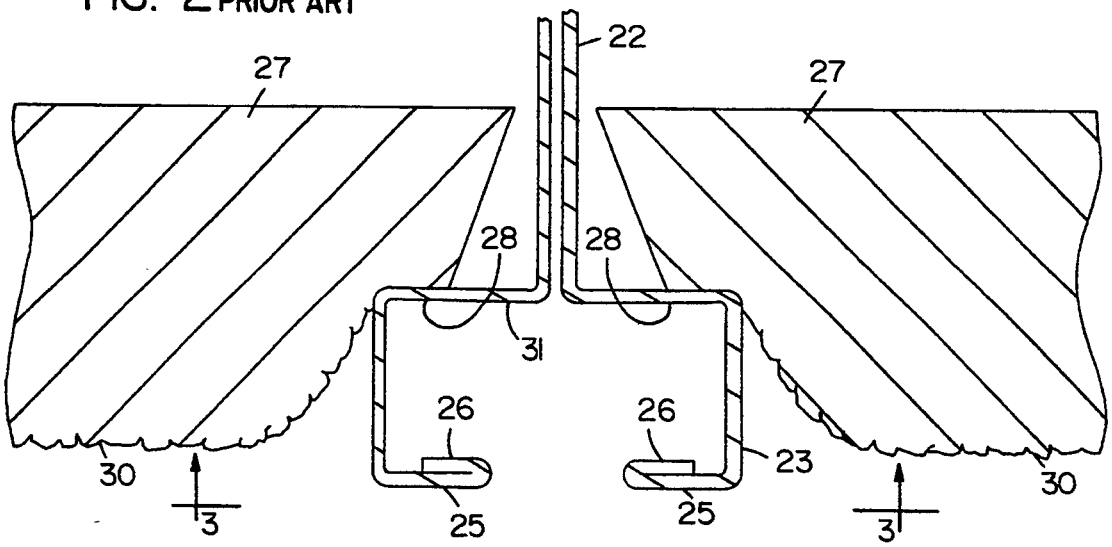
FIG. 2 PRIOR ART
FIG. 2 is an enlarged fragmentary sectional elevational view taken on the line 2,2 of FIG. 1, clearly showing details of the channel flange supporting the stepped edge of the ceiling tiles and designated prior art.
Figure 3:
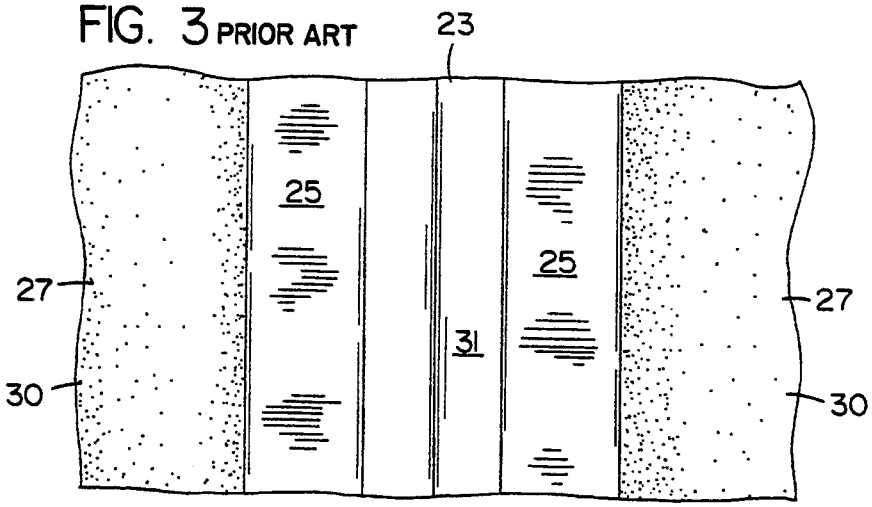
FIG. 3 PRIOR ART
FIG. 3 is a fragmentary bottom plan view taken on the line 3,3 of FIG. 2, illustrating additional visual details.

As seen in FIGS. 1 through 3, a beam 20 suspended in the usual way, has a bulb 21, web 22 and channel 23 with inwardly extending flats 25 folded back at 26. A tile 27 has an edge groove 28 so that the bottom 30 of tile 27 lies in a horizontal plane close to that of the plane of flats 25. As set forth in the '272 patent referred to earlier, the groove 31 in channel 23 is of a different color than flats 25. Tile 27 can be of the same color as either groove 31 or flats 25, or of a still different color. The total effect to a viewer from below is a three-dimensional color contrast.

When continuity of the groove color is desired in all directions, at the intersection of the support beams with the transverse beams, it is necessary to either notch the channel or provide a special clip in order to provide continuity of the groove color in all directions, as seen in the '272 patent.

The Present Invention Generally

Figure 4:
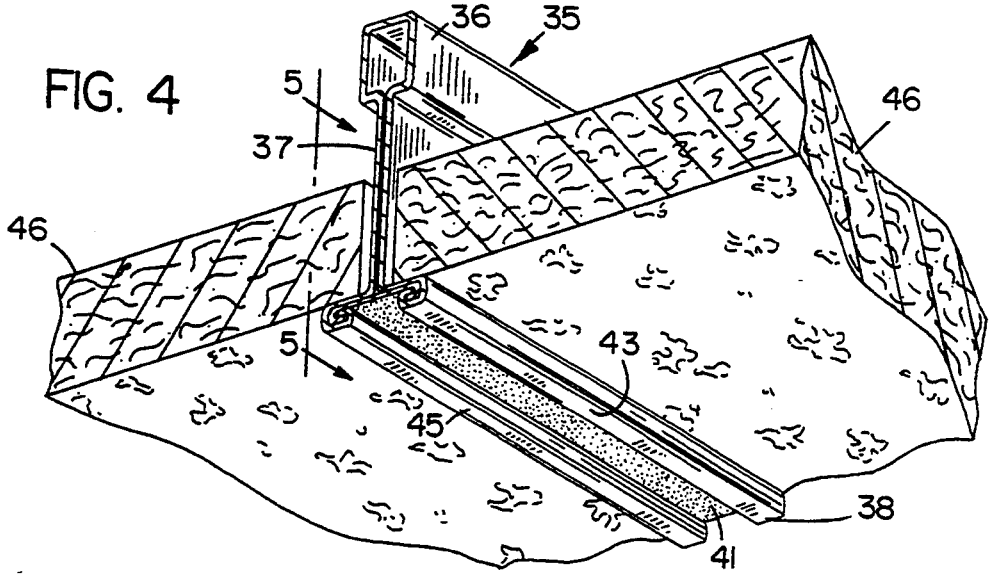
FIG. 4 is a fragmentary perspective view illustrating a portion of metallic grid member in the form of an inverted T with flanges that support ceiling tiles. Two fragmentary portions of ceiling tiles are shown in position in the drawing. The flange includes a second strip that is secured within the rolled flats of the flange, exposing the strip in a centrally located axially extending plane between the rolled-over flats of the flange.
Figure 5:
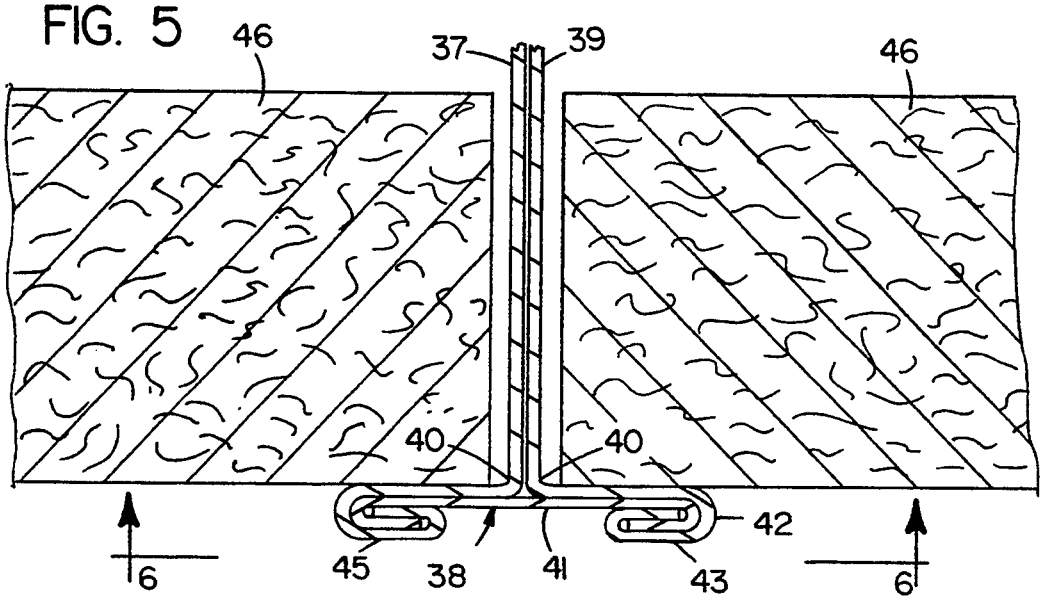
FIG. 5 is an enlarged fragmentary sectional elevational view taken on the line 5,5 of FIG. 4, showing details of the tile supporting flange and the included strip, secured by the rolled flats of the flange. The flange is shown supporting two fragmentary end portions of conventional ceiling tile.
Figure 6:
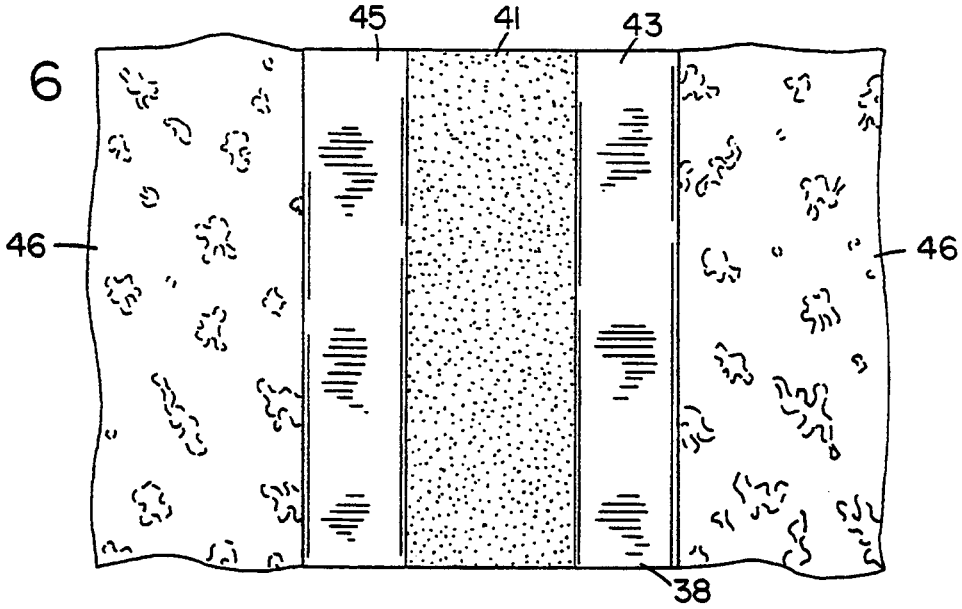
FIG. 6 is a fragmentary plan view taken on the line 6,6 of FIG. 5, showing the visual effect created when the flange flats are of a different color from the tiles and the centrally located second strip is of a contrasting color.

The present invention as seen in FIGS. 4 through 6 corresponds to FIGS. 1 through 3 described above as prior art. Beam 35 has, in conventional fashion, a bulb 36, a web 37, and a relatively flat flange 38.

It is flange 38 which is different and provides the invention.

When beam 35 is formed by, for instance, rolls, a first strip of metal 39 of a first color is bent symmetrically about the longitudinal center line, as well known, to form the bulb 36, and then bent into adjacent layers to form web 37. Each edge of the first strip 39 is then flared outwardly opposite one another to begin forming the flange of the T at 40. At this point, a flat second strip 41, preferably, but not necessarily, of a different material, texture, or color from strip 39, of a suitable width so as to permit first strip 39 to be bent around inner flat strip 41 at 42 and 43, is laid against the oppositely flared upper layer of flange 38. Strip 41 may be of metal, either similar or dissimilar to the flange metal; a vinyl, a fabric, or other suitable material, which may or may not have structural strength of its own.

Strips 39 and 41 are then continuously bent by the rolls until they achieve the final construction of flange 38 as seen for instance in cross section in FIG. 5. In such form, longitudinally extending flats 43 and 45 are formed along the exposed portion of longitudinally extending inner second strip 41. Flats 43 and 45 extend in a horizontal plane below the horizontal surface of second strip 41.

When viewed from below, as seen in FIGS. 4 and 6, flats 43 and 45 extend on either side of the exposed portion of strip 41 and are preferably of a different color and/or texture. The color and/or texture is applied to strips 39 and 41 when they are in flat, continuous web form, and before the strips are fabricated into the grid beam 35 described.

Flat tiles, or panels 46 are laid on flange 38 in the conventional manner. Tiles 46 may be of the same color as either flats 43 and 45 or strip 41, or of a different color.

When viewed from below, the ceiling of the invention achieves a three-dimensional effect among the tiles 46, flats 43 and 45, and strip 41. Particularly where a dark color, such as a dark bronze, is used on the inner strip 39, and an off-white on the flats, the effect is remarkably similar to that of the prior art channel flange described earlier. The slightly different planes of the inner strips and flats also contribute to to the marked three-dimensional effect.

Additionally, in the prior art channel flange, it is necessary to use a grooved tile to bring its lower surface down toward the flats 25 of the channel 23, to avoid an unattractive vertical expanse between the flats 25 and the lower surface of tile 27, as seen in FIGS. 1 through 3. An edge groove adds to the expense of the tile. No such grooved tile is necessary in the present invention. A regular, prior art, flat tile 46 is used. The lower surface of the tile is above the surface of flats 43 and 45, thus contributing to the three-dimensional effect.

It may be desirable to have continuous uninterrupted second strip 41 exposure in all directions at beam intersections. In FIGS. 7 through 9, there is shown the construction of flange 38 at the intersection of a main beam 50 and an intersecting beam 51, when the flange is notched. Beam 51 has a tongue 52, of any prior art design, passing through a slot 53 in main beam 50 and hooking thereto, again as well known.

Flats 43 and 45 are cut away at 55 to an extent that conforms to the width of the inner second strip 41 on intersecting beams 50 and 51, as seen in FIGS. 7 and 9.

Such cutout yields a cross shape of inner strip 41 and is desirably formed during the fabrication of the grid beam 35 by cutting the flat strips 39 and 41 prior to the bending operation as described earlier. The location of the cutout can be coordinated with the punching of slot 53.

Flange 38 is cut to provide an offset at 47 as is well known in the construction of intersecting beams for grid ceilings.

Main grid beam 50 remains relatively strong at the cutout location at 56, since flange 38 still has its upper surface as well as any structural strength from the inner flat strip 41. Of course, the beam continues to have the structure of web 37 and bulb 36.

When the beam construction of the invention is notched, when viewed from below as in FIGS. 7 and 9, the intersecting grid beams have continuous cross-shaped contrasting color exposed inner strip 41, with flat tiles 46 supported from flanges 38.

The Present Invention Specifically

Figure 10:
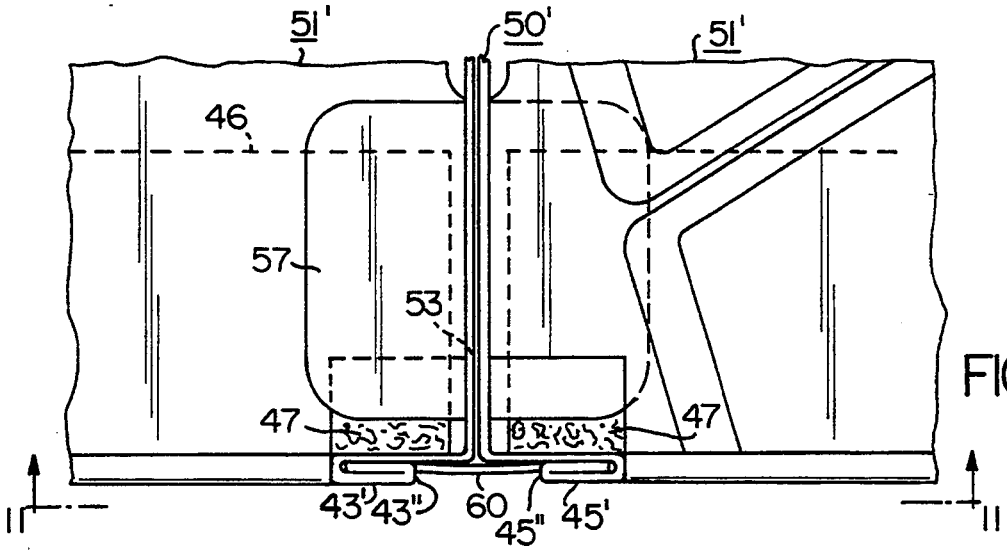
FIG. 10 is an enlarged fragmentary sectional elevational view similar to FIG. 8, showing a modification wherein the main and interconnecting beams have rolled flange edges whose inner slots frictionally retain a narrow decorative strip.
Figure 11:
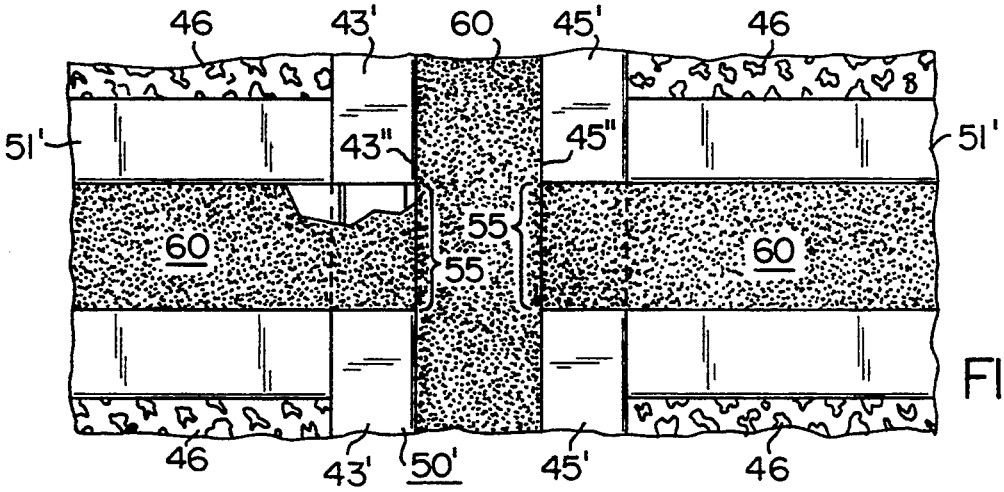
FIG. 11 is a fragmentary bottom plan view taken on the line 11,11 of FIG. 10, showing the continuity of design of the decorative strips at points of intersection of the main and interconnecting beams created by means of projecting tabs of decorative strip extending beyond the terminal end of the connecting beams.
Figure 12:
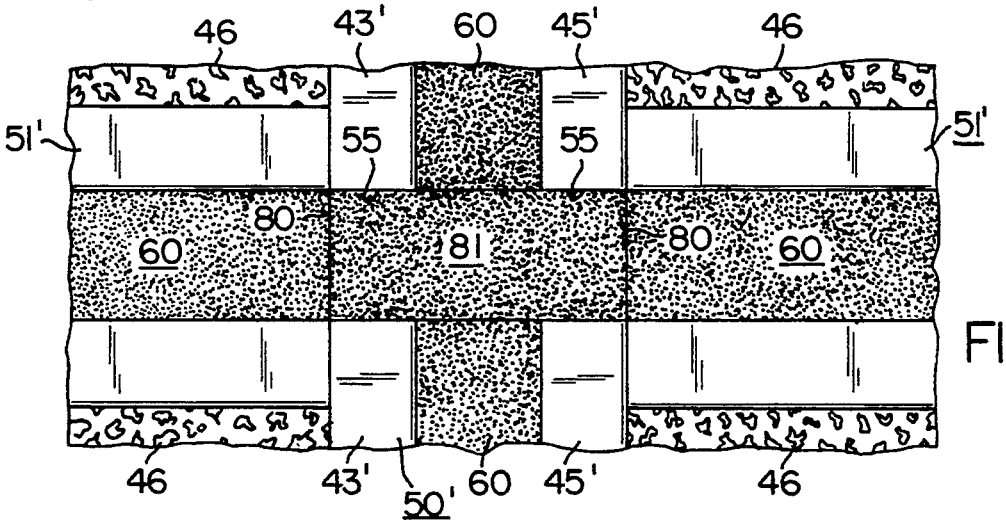
FIG. 12 is a fragmentary bottom plan view similar to FIG. 11, but showing another modification wherein the continuity of design of the decorative strips is maintained at points of intersection of the main and interconnection beams by means of a rectangular strip of decorative metal or a pliable material having one face coated with a color matching the color of the decorative strip in use.

As seen in FIGS. 10 through 12, the beam is generally of the same type as described earlier with reference to the earlier drawings. With intersecting beams 50' and 51' corresponding to the earlier described intersecting beams 50 and 51 as seen in FIGS. 7 and 9, in the present arrangement flats 43' and 45' are formed without bending over or overlapping second strip 60 which extends between bends 43'' and 45''.

In the embodiment of FIGS. 10 to 12, strip 60 is slightly bent concavely downward as seen in FIG. 10 and force-fitted between bends 43' and 45'. Friction holds strip 60 in place. As described above in the earlier embodiments, strip 60 extends continuously along the lower surface of beam 50'.

Alternatively, strip 60 can be secured to the lower surface of beam 50' as for instance by adhesive, tack or spot welding, riveting or any other suitable mechanical or other means.

At the intersection of beams as seen in FIG. 11, strips 60 can be extended into cutout 55 from the intersecting beams, whereas in the-embodiment of FIG. 12, the second strip terminates on the intersecting and main beams at 80, and a separate short rectangular strip 81 is inserted to fill up the void. FIGS. 11 and 12 have cutouts 55 as described earlier with reference to FIGS. 7 through 9.

We claim:

1. A grid beam for a suspended ceiling having tile supported by the beam wherein the beam is of an inverted T cross section formed of a first strip of metal bent into a bulb, a web, and a flange, the flange having a longitudinal center line and a lower surface with a width and sides, the improvement comprising (1) a pair of flats on the lower surface of the flange, each of the flats (a) formed of bends of the first strip (b) extending substantially continuously longitudinally along opposite sides of the flange, (c) having a lower surface exposed to viewing from below, and (d) having the lower surface lying in a first horizontal plane, and (2) a second strip (a) extending substantially the full length of the flange, (b) having a width at least substantially equal to the distance between the flats;

(c) continuously and permanently secured on the lower surface of the flange, (d) exposed between the flats to viewing from below, and (e) having a lower surface in a second horizontal plane located above the first horizontal plane, so that when viewed from below, the second strip is exposed along the longitudinal center line of the flange between the flats, and the flats are exposed longitudinally along the sides of the flange, with the lower surface of the second strip above the lower surface of the flats, whereby, a three-dimensional effect is achieved to a viewer located below the ceiling.

2. The beam of claim 1 wherein the first strip is of a different color from the second strip, whereby a color effect is achieved.

3. The beam of claim 1 wherein the first strip is of a different material or surface texture.

4. The beam of claim 1 wherein the flats have cutouts and portions of the second strip extend across the width of the beam at the cutouts, wherein the second strip extends across the width of the flange at locations along the beam where intersecting beams are adapted to be joined.

5. The beam of claim 4 wherein the cutouts expose the second strip in a cross shape.

* * * * *